US009461365B2

(12) United States Patent
Iellici

(10) Patent No.: US 9,461,365 B2
(45) Date of Patent: Oct. 4, 2016

(54) LTE ANTENNA PAIR FOR MIMO/DIVERSITY OPERATION IN THE LTE/GSM BANDS

(75) Inventor: Devis Iellici, Cambridge (GB)

(73) Assignee: Microsoft Technology Licensing, LLC, Redmond, WA (US)

( * ) Notice: Subject to any disclaimer, the term of this patent is extended or adjusted under 35 U.S.C. 154(b) by 296 days.

(21) Appl. No.: 13/878,976

(22) PCT Filed: Oct. 5, 2011

(86) PCT No.: PCT/GB2011/051897

§ 371 (c)(1),
(2), (4) Date: Apr. 11, 2013

(87) PCT Pub. No.: WO2012/049476

PCT Pub. Date: Apr. 19, 2012

(65) Prior Publication Data

US 2013/0194156 A1 Aug. 1, 2013

(30) Foreign Application Priority Data

Oct. 15, 2010 (GB) ..... 1017481.1

(51) Int. Cl.
*H01Q 21/00* (2006.01)
*H01Q 7/00* (2006.01)
(Continued)

(52) U.S. Cl.
CPC ..... *H01Q 7/00* (2013.01); *H01Q 1/2275* (2013.01); *H01Q 1/243* (2013.01); *H01Q 1/38* (2013.01); *H01Q 1/48* (2013.01); *H01Q 1/521* (2013.01); *H01Q 7/005* (2013.01); *H01Q 25/00* (2013.01)

(58) Field of Classification Search
CPC ..... H01Q 7/00; H01Q 21/00
USPC ..... 343/867, 860, 702, 700 MS, 742
See application file for complete search history.

(56) References Cited

U.S. PATENT DOCUMENTS 6,842,158 B2 1/2005 Jo et al.
7,298,339 B1 11/2007 Ollikainen
(Continued)

FOREIGN PATENT DOCUMENTS

CN 1345473 A 4/2002
CN 101030672 A 9/2007
(Continued)

OTHER PUBLICATIONS

"Office Action Received in United Kingdom Patent Application No. 1017481.1", Mailed Date: Feb. 19, 2014, Filed Date: Oct. 15, 2010, 5 Pages.
(Continued)

*Primary Examiner* — Huedung Mancuso
(74) *Attorney, Agent, or Firm* — Qudus Olaniran; Judy Yee; Micky Minhas

(57) ABSTRACT

There is disclosed a multiple-input multiple-output (MIMO) antenna system comprising first and second folded or compacted loop antennas (12, 121). The antennas each have a longitudinal extent and are mounted substantially parallel to each other on a dielectric substrate (3) having a conductive groundplane (31, 32). The groundplane extends between the first and second antennas, and the first and second antennas are mounted on the substrate in areas where there is no groundplane. The first and second antennas, in use, generate first and second radiation patterns (31, 32) and also cause currents (30) to flow in the groundplane between the antennas so as to skew the first and second radiation patterns relative to each other by an angle greater than zero, and preferably at an angle of around 50 degrees.

22 Claims, 10 Drawing Sheets

(51) Int. Cl.

| | |
|---|---|
| ***H01Q 1/22*** | (2006.01) |
| ***H01Q 1/24*** | (2006.01) |
| ***H01Q 1/38*** | (2006.01) |
| ***H01Q 1/48*** | (2006.01) |
| ***H01Q 1/52*** | (2006.01) |
| ***H01Q 25/00*** | (2006.01) |

(56) References Cited

U.S. PATENT DOCUMENTS

| | | | | |
|---|---|---|---|---|
| 8,362,968 | B2 | 1/2013 | Fukuda | |
| 2003/0156065 | A1* | 8/2003 | Jo et al. | 343/700 MS |
| 2004/0252061 | A1* | 12/2004 | Vance | 343/702 |
| 2005/0007283 | A1* | 1/2005 | Jo et al. | 343/702 |
| 2005/0119035 | A1 | 6/2005 | Miyano et al. | |
| 2005/0190110 | A1 | 9/2005 | Taromaru et al. | |
| 2005/0275598 | A1 | 12/2005 | Ohara | |
| 2007/0164920 | A1 | 7/2007 | Chen | |
| 2009/0243947 | A1 | 10/2009 | Tsai et al. | |
| 2010/0156723 | A1* | 6/2010 | Luch | 343/700 MS |
| 2012/0133571 | A1 | 5/2012 | Collins et al. | |
| 2013/0201074 | A1 | 8/2013 | Harper et al. | |

FOREIGN PATENT DOCUMENTS

| | | | |
|---|---|---|---|
| CN | 101572356 | A | 11/2009 |
| CN | 101627505 | A | 1/2010 |
| CN | 101652898 | A | 2/2010 |
| EP | 1206000 | A2 | 5/2002 |
| GB | 2450786 | A | 1/2009 |
| JP | 56-012102 | A | 2/1981 |
| JP | H10-247807 | A | 9/1998 |
| JP | 2000-077934 | A | 3/2000 |
| JP | 2004-096209 | A | 3/2004 |
| JP | 2004-140815 | A | 5/2004 |
| JP | 2005-124061 | A | 5/2005 |
| JP | 2005-175902 | A | 6/2005 |
| JP | 2006-174095 | A | 6/2006 |
| JP | 2010081268 | | 4/2010 |
| JP | 2010130115 | A | 6/2010 |
| RU | 2208298 | C2 | 7/2003 |
| RU | 2380800 | C2 | 1/2010 |
| WO | 2006120250 | A2 | 11/2006 |
| WO | 2010095136 | A1 | 8/2010 |

OTHER PUBLICATIONS

"First Office Action and Search Report Received in China Patent Application No. 201180049868.5", Mailed Date: May 5, 2014, Filed Date: Oct. 5, 2011, 15 Pages.

"Office Action Received in Russia Patent Application No. 2013120479", Mailed Date: Dec. 24, 2013, Filed Date: Oct. 5, 2011, 3 Pages. (w/o English Translation).

UK Examination Report under Section 18(3) issued Jul. 22, 2014—UK Application No. GB1017481.1, 4 pages.

Kim, J., "Dual Band MIMO Antenna Using ENG Zeroth Order Resonator for 4G System," (abstract only); published in Antenna Technology, 2009, iWAT 2009, IEEE International Workshop on Mar. 2-4, 2009.

"Second Office Action and Search Report received in China Patent Application 201180049868.5," mailed date: Jan. 7, 2015; Filing Date: Oct. 5, 2011, 6 pages.

"First Office Action and Search Report Issued in Taiwan Patent Application No. 100136914", Mailed Date: Feb. 11, 2015, 8 Pages.

"Second Office Action Received for United Kingdom Patent Application No. 1017481.1", Mailed Date: Nov. 27, 2014, 2 Pages.

Su, Saou-wen, "Concurrent 2.4/5-GHz multi-loop MIMO antennas with wide 3-dB beamwidth radiation for access-point applications," IEEE publication, 2010 Proceedings of the Fourth European Conference on Antennas and Propagation (EuCAP), Apr. 12-16, 2010, Barcelona, Spain (1 pages abstract).

Search Report, State Intellectual Property Office of People's Republic China; Search Report for 201180049868.5 dated Oct. 5, 2011, 2 pages.

International Search Report and Written Opinion for corresponding PCT Application No. PCT/GB2011/051897, dated Dec. 27, 2011 (15 pages).

Saou-Wen Su, "Concurrent 2.4/5-GHz Multi-Loop MIMO Antennas with Wide 3-dB Beamwidth Radiation for Access=-Point Applications," Antennas and Propagation (EUCAP), 2010 Proceedings of the Fourth European Conference on, IEEE, Piscataway, NJ, USA, Apr. 12, 2010, XP031706083 (5 pages).

"Office Action Issued in Japanese Patent Application No. 2013-533282", Mailed Date: Jun. 16, 2015, 5 Pages. (w/o English Translation).

Third Office Action and Search Report Issued in China Patent Application No. 201180049868.5, Mailed Date: Aug. 3, 2015, 14 Pages.

Notice of Allowance Issued in Russia Patent Application No. 2013120479, Mailed Date: Sep. 9, 2015, 8 Pages. (W/O English Translation).

Notice of Allowance Issued in Taiwan Patent Application No. 100136914, Mailed Date: Dec. 31, 2015, 4 Pages.

Fourth Office Action and Search Report Issued in Chinese Patent Application No. 201180049868.5, Mailed Date: Jan. 12, 2016, 11 Pages.

* cited by examiner

| MARKERS: | MHz | dB | MHz | dB |
|---|---|---|---|---|
| Cellular - S11 | 1: 824 | -3.41 | 3: 1710 | -11.93 |
| | 2: 960 | -6.66 | 4: 2170 | -6.16 |
| Cellular - S22 | 1: 824 | -3.56 | 3: 1710 | -11.71 |
| | 2: 960 | -7.10 | 4: 2170 | -6.08 |
| Cellular - S21 | 1: 824 | -15.12 | 3: 1710 | -10.12 |
| | 2: 960 | -13.70 | 4: 2170 | -19.34 |
| LTE- S11 | 1: 746 | -6.99 | 3: 2500 | -3.70 |
| | 2: 798 | -4.21 | 4: 2690 | -6.51 |
| LTE - S22 | 1: 746 | -7.59 | 3: 2500 | -5.28 |
| | 2: 798 | -4.48 | 4: 2690 | -5.49 |
| LTE - S21 | 1: 746 | -5.96 | 3: 2500 | -16.62 |
| | 2: 798 | -7.86 | 4: 2690 | -20.18 |

Isolation worse than
what is expected in the high-bands

| MARKERS: | MHz | dB | MHz | dB |
|---|---|---|---|---|
| Cellular - On Laptop - S11 | 1: 824 | -5.75 | 3: 1710 | -18.25 |
| | 2: 960 | -11.97 | 4: 2170 | -7.09 |
| Cellular - On Laptop - S22 | 1: 824 | -7.24 | 3: 1710 | -44.03 |
| | 2: 960 | -16.37 | 4: 2170 | -5.21 |
| Cellular - On Laptop - S21 | 1: 824 | -9.47 | 3: 1710 | -13.52 |
| | 2: 960 | -7.07 | 4: 2170 | -19.09 |
| LTE- On Laptop - S11 | 1: 746 | -7.28 | 3: 2500 | -3.67 |
| | 2: 798 | -5.89 | 4: 2690 | -6.67 |
| LTE - On Laptop - S22 | 1: 746 | -9.71 | 3: 2500 | -5.13 |
| | 2: 798 | -6.25 | 4: 2690 | -5.72 |
| LTE - On Laptop - S21 | 1: 746 | -9.91 | 3: 2500 | -16.37 |
| | 2: 798 | -8.98 | 4: 2690 | -19.59 |

LTE ANTENNA PAIR FOR MIMO/DIVERSITY OPERATION IN THE LTE/GSM BANDS

This invention relates to a pair of loop antennas for mobile handset applications, and in particular to operation on the LTE network where more than one antenna is required on each handset.

BACKGROUND

Long Term Evolution (LTE) is the latest standard under development for mobile network technology. It is designed to enable wireless providers using both GSM and 3G networks to transition to fourth generation (4G) networks and equipment. For consumers, LTE will enable existing applications to run faster, and will also make available new mobile phone applications. In order to obtain the higher data rates required for these new applications, LTE has adopted multiple-input multiple-output (MIMO) technology, which will require mobile phones to have two cellular radio antennas. LTE also uses lower frequencies than the GSM band and mobile phone antennas will now have to have low band performance extended down to 698 MHz (from 824 MHz at present). This combination of needing two antennas and lower frequency performance presents significant problems for the designer of antennas for mobile platforms.

In order for a pair of antennas to give good diversity performance or work successfully in a MIMO system they need to sample, to a certain extent, different multipath signals arriving at the equipment terminal. This means, in effect, that the antennas must be different in some way by having different beam patterns, different polarisations, phase responses or be physically well separated electrically (spatial diversity).

An indication of how similar two antennas are is given by the envelope correlation coefficient $\rho_e$, which is a measure of how the radiation patterns of two antennas differ in shape, polarization and phase. A low correlation is very important for the performance of a MIMO system because when $\rho_e=1$ the patterns are identical and no MIMO or diversity gain is possible. However, when $\rho_e=0$ optimal MIMO gain is achieved. It is important to note that that the overall performance of the two antennas must be similar; good MIMO performance cannot be achieved using one efficient antenna and one inefficient antenna. Both must have similar efficiencies, but be different in one or more of the characteristics listed above.

Recently it has been shown that loop antenna technology can be used for mobile phone applications and, by means of switching or electronic tuning, can be configured to cover the LTE bands as well as the GSM bands, for example as described in the present Applicant's co-pending UK patent application no GB0914280.3. Recent developments designed to improve bandwidth include multi-moding the loops, complex feed and grounding arrangements and complex structural arrangements towards the centre of the loop designed to improve the match to 50 ohms. Some of these developments are described in detail in the present Applicant's co-pending UK patent application no GB1017472.0, the content of which is incorporated into the present application by reference.

BRIEF SUMMARY OF THE DISCLOSURE

According to a first aspect of the present invention, there is provided a multiple-input multiple-output (MIMO) antenna system comprising first and second folded or compacted loop antennas each having a longitudinal extent and mounted substantially parallel to each other on a dielectric substrate having a conductive groundplane, wherein the groundplane extends between the first and second antennas, but wherein the first and second antennas are mounted on the substrate in areas where there is no groundplane, and wherein the first and second antennas, in use, generate first and second radiation patterns and also cause currents to flow in the groundplane between the antennas so as to skew the first and second radiation patterns relative to each other by an angle greater than zero.

The first and second antennas may be mounted relative to each other in a manner similar to a pair of Helmholtz coils, although it is not essential or even necessarily preferably that the antennas are spaced from each other by a distance similar to a radius of each loop. However, it is preferred that the loops of the first and second loop antennas are substantially co-axial. The greater the spacing between the first and second antennas, the greater the diversity.

Each of the first and second loop antennas may be configured as described in co-pending UK patent application no GB1017472.0, that is, each loop antenna may be configured as a loop of conductive track that is formed on a dielectric substrate in a compact manner by folding the loop over an edge of the substrate so to form first and second patches. Alternatively, first and second patches may communicate galvanically with each other by way of vias in the substrate so as to define a compacted loop. In other embodiments, the loop may be compacted in a single plane by meandering or otherwise folding the conductive track. In all embodiments, the expression "folded or compacted loop antenna" is intended to signify a loop antenna formed by a conductive track in a topologically loop-shaped configuration that encloses an area smaller than would be enclosed by the conductive track if it were opened out into a circle. In most embodiments, the enclosed area is smaller than that which would be enclosed by the conductive track if it were to be opened out into a square or rectangle. This is because the compacted or folded loop generally includes at least one re-entrant portion, typically where the loop passes from one side of the substrate to the other.

Embodiments of the present invention make use of two loops disposed on a mobile phone handset, USB dongle or other small platform in order to achieve MIMO or diversity operation.

The first and second antennas may be identical to each other in construction and/or performance, or may be different. Both loops may be mounted vertically with respect to a horizontal substrate with a groundplane and parallel to each other. In particularly preferred embodiments, the antenna system is arranged so that each loop can be easily mounted vertically on a main PCB of a USB dongle.

One end of each of the first and second loop antennas is connected to an RF feed for the appropriate signal. The other end of each loop antenna may be connected directly to ground (for example by connecting to the groundplane), but advantageously the other end of one or both of the loop antennas is respectively connected to ground by way of at least one inductive component to adjust the effective length of the loop. In particularly preferred embodiments, the other end of the one or each of the loop antennas is provided with a switch allowing two or more different inductive components to be switched in between the other end and ground, thereby allowing the electrical length of the loop to be adjusted as required.

With the loops parallel to each other, and electrically closely spaced, it might be thought that a low envelope correlation could not be achieved on a platform as small as a dongle. However, inspection of the currents flowing in the groundplane of the dongle shows that the two radiation patterns may be skewed so as to have an angular difference between them. In currently preferred embodiments, the angle between the radiation patterns is at least 20 degrees, preferably at least 35 degrees, and most preferably around 50 degrees or at least 50 degrees. An angular difference of 50 degrees can give rise to a correlation coefficient of around 0.4, which is considered to be adequate for MIMO and diversity applications.

In a typical dongle application there will be a requirement for a 'main' antenna covering the LTE and GSM bands and a second antenna for LTE MIMO or diversity use. This means that the two antennas do not need to have identical construction or performance. Alternatively or in addition, they do not need to be electrically switched and matched in the same way.

In one embodiment, both antennas may be identical but have electrical switching circuits that may be used in identical or different ways. In some embodiments, three switching states are provided but configurations with two, four or other numbers of states are also possible. Measurements of the cross-correlation between the first and second loop antennas shows that $\rho_e \leq 0.5$ or less across all the band used by the LTE protocol.

This result, combined with the good bandwidth and efficiency of the antennas, means that they are suitable to meet the needs of LTE.

BRIEF DESCRIPTION OF THE DRAWINGS

Embodiments of the invention are further described hereinafter with reference to the accompanying drawings, in which.

DETAILED DESCRIPTION

Figure 1:
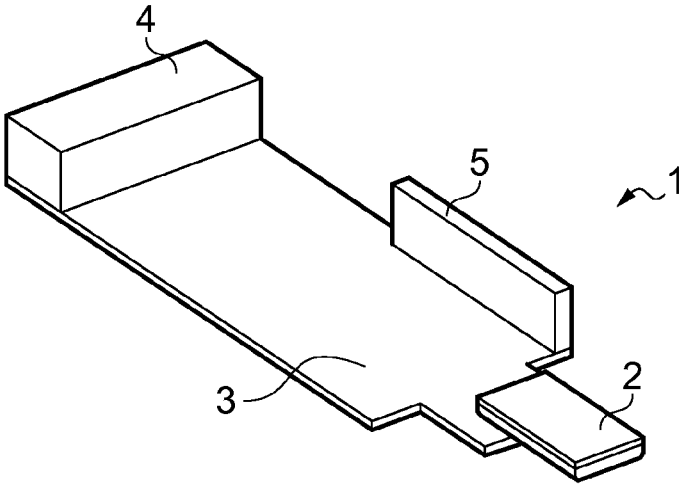
FIG. 1 shows a first prior art USB dongle antenna configuration for LTE.
Figure 2:
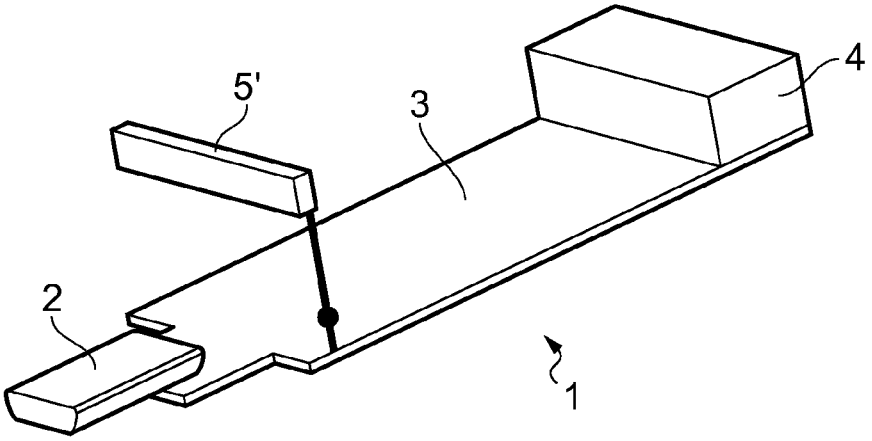
FIG. 2 shows a second prior art USB dongle antenna configuration for LTE.

FIG. 1 shows a first prior art MIMO USB dongle 1 in schematic form with the housing removed. The dongle 1 comprises a USB connector 2, a PCB substrate 3, a main antenna 4 and an orthogonally-disposed secondary antenna 5. An alternative arrangement is shown in FIG. 2, where the secondary antenna 5' is elevated above the PCB substrate 3 and can be swivelled about a stalk 6 on which the antenna 5' is mounted. For clarity, no other dongle components are shown, although it will be appreciated that the PCB substrate 3 will be populated with various components such as memory and processor circuits. MIMO USB dongles 1 of this type are intended for use as USB modems that can be plugged into laptop or other computers, thereby allowing data transmission and reception by way of an LTE mobile network. The main antenna 4 in each case is generally dedicated to LTE, GSM and HSPA signals, while the secondary antenna 5, 5' provides spatial diversity for LTE signals. However, the secondary antenna 5, 5' has reduced performance relative to the main antenna 4, and therefore the USB dongle 1 as a whole displays sub-optimal MIMO and a reduced data transfer rate.

Figure 3:
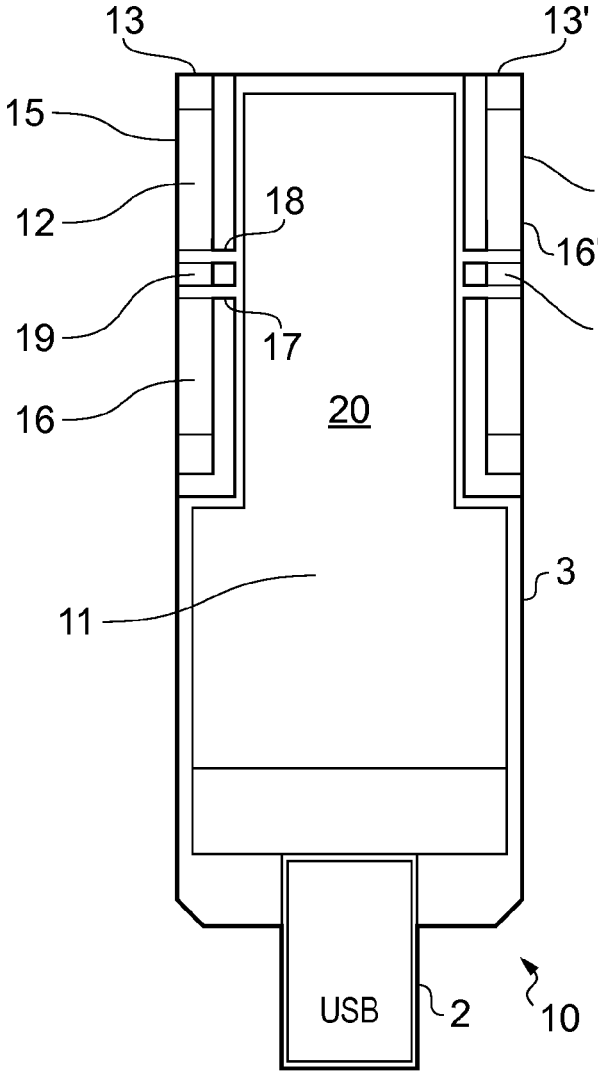
FIGS. 3 and 4 show an embodiment of the present invention.
Figure 4:
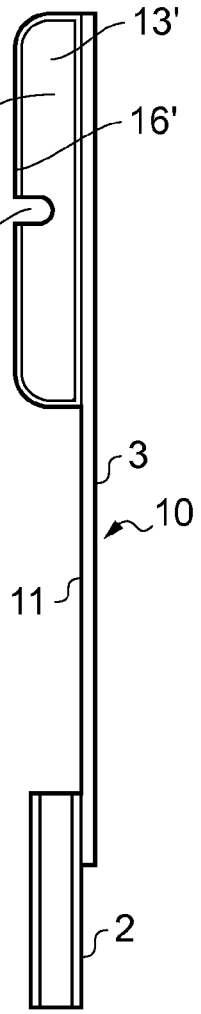

FIGS. 3 and 4 show an embodiment of the present invention, again in schematic form. A MIMO USB dongle 10 comprises a USB connector 2, a PCB substrate 3 in the form of a dielectric board such as FR4, a conductive groundplane 11, and a pair of folded or compacted loop antennas 12, 12' disposed parallel to and opposite each other on the longer edges of the PCB substrate 3. It will be seen that the loop antennas 12, 12' are vertically mounted with respect to a plane of the substrate 3, and are surface mounted on regions of the substrate 3 where no groundplane 11 is present. The groundplane 11 does, however, extend between the antennas 12, 12'.

Each antenna 12, 12' comprises a loop formed of a conductive track 16, 16' printed or otherwise formed on a dielectric substrate 13, 13'. In particular, each loop antenna 12 may comprise a dielectric substrate 13 having first 14 and second 15 opposed surfaces and a conductive track 16 formed on the substrate 13, wherein there is provided a feed point 17 and a grounding point 18 adjacent to each other on the first surface 14 of the substrate 13, with the conductive track 16 extending in generally opposite directions from the feed point 17 and grounding point 18 respectively, then extending towards an edge of the dielectric substrate 13, then passing to the second surface 15 of the dielectric substrate 13 and then passing across the second surface 15 of the dielectric substrate 13 along a path generally following the path taken on the first surface 14 of the dielectric substrate 13, before connecting to respective sides of a conductive arrangement formed on the second surface 15 of the dielectric substrate 13 that extends into a central part of a loop formed by the conductive track 16 on the second surface 15 of the dielectric substrate 13, wherein the conductive arrangement comprises both inductive and capacitive elements. Instead of a conductive arrangement comprising both inductive and capacitive components, a simple conductive loading plate may galvanically connect the two ends of the conductive track 16 on the second surface 15, or the conductive track 16 may form a continuous loop on the second surface 15. In another embodiment, instead of having both a feed point 17 and a grounding point 18, the antenna 12 may have two grounding points 18, and be excited by a separate driven loop or monopole antenna (not shown) configured to couple inductively or capacitively with the antenna 12.

In FIG. 3, the dielectric substrates 13, 13' have central notches 19, 19' cut out where the electric field will be highest during operation. This helps to improve efficiency.

The area 20 of the PCB substrate 3 and the groundplane 11 between the antennas 12, 12' and the USB connector 2 can be populated with other circuit components (not shown). Indeed, provided that they do not interfere too strongly with the antennas 12, 12', further circuit components may be mounted between the antennas 12, 12'.

It can be seen that the design of embodiments of the present invention is symmetrical about a mirror plane along the centre line of the USB dongle 10, in contrast to the illustrated prior art arrangements.

FIGS. 5 to 8 illustrate the theoretical background underlying embodiments of the invention. With the loop antennas 12, 12' parallel to each other, and electrically closely spaced, it might be thought that a low envelope correlation could not be achieved on a platform as small as a dongle 10. However, inspection of the currents 30 flowing in the groundplane 11 of the dongle 10, shows that the two radiation patterns 21, 22 may be skewed so as to have a difference of 50 degrees between them. This angular difference gives rise to a correlation coefficient of 0.4, which is considered to be adequate for MIMO and diversity applications. In particular, it will be noted that locating the antennas 12, 12' on diagonally opposite corners of the PCB substrate 3 of the dongle 10 results in the antennas 12, 12' operating in the same mode, which leads to high correlation and loss of diversity. Diagonal modes, with the antennas 12, 12' on the same edge or end of the PCB substrate 3, are required to give mid to low correlation and hence reasonable diversity.

Figures 5, 6, 7, 8:
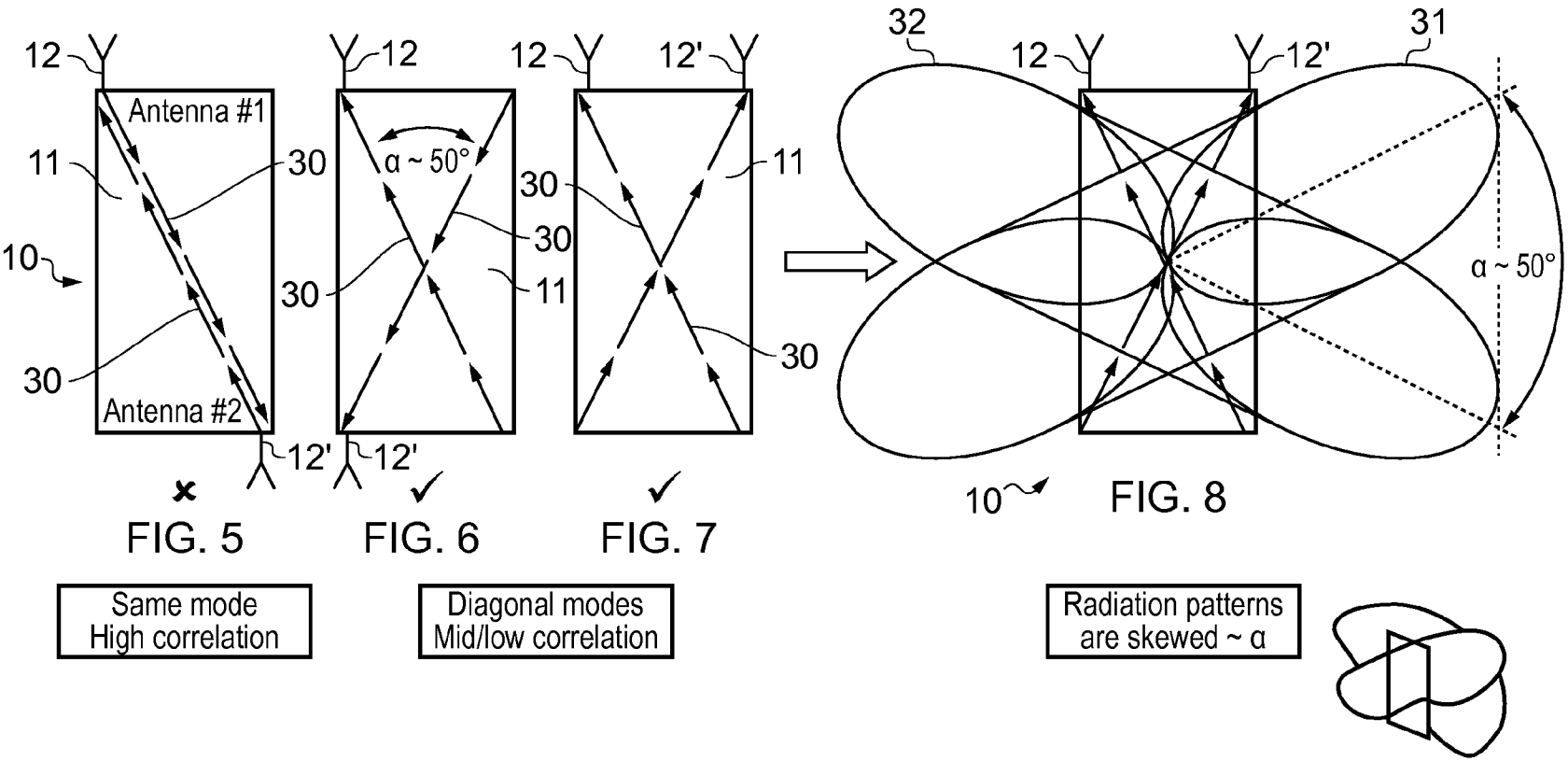
FIGS. 5 to 8 illustrate the theoretical background underlying embodiments of the invention.

FIG. 8 shows the first 31 and second 32 radiation patterns generated by the antenna system, and demonstrates that they are skewed relative to each other by 50 degrees, thereby providing reasonable diversity.

In a typical dongle application there will be a requirement for a 'main' antenna 12 covering the LTE and GSM bands and a second antenna 12' for LTE MIMO or diversity use. This means that the two antennas 12, 12' do not need to have identical construction or performance or they do not need to be electrically switched and matched in the same way. In the illustrated embodiments, both antennas 12, 12' are identical but have electrical switching circuits that may be used in identical or different ways, as shown FIG. 9.

Figure 9:
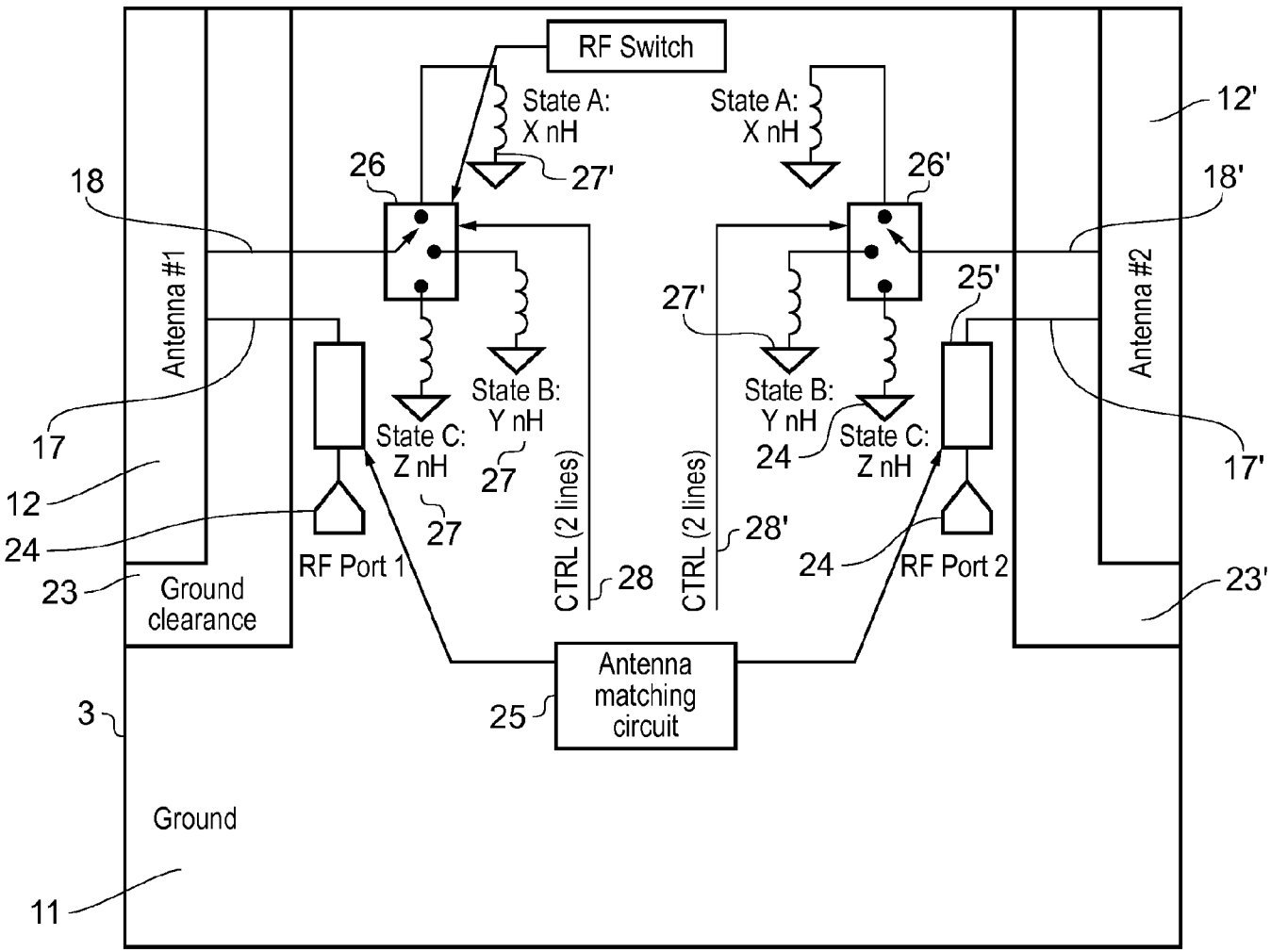
FIG. 9 shows an exemplary connection scheme for an embodiment of the present invention.

FIG. 9 shows the PCB substrate 3 with its groundplane 11, as well as two islands or regions 23, 23' at opposed edges where no groundplane 11 is present. Each antenna 12, 12' has an RF feed point 17, 17' to which is connected an RF feed port 24, 24' and an antenna matching circuit 25, 25'. Each antenna 12, 12' also has a grounding point 18, 18' which connects to ground by way of a switch 26, 26' allowing switching between three different ground connections 27, 27' with different inductances. The switches 26, 26' are controlled by way of control lines 28, 28'. In the example shown, three switching states are shown but configurations with two, four or other numbers of states are also possible. Measurements of the cross-correlation between the antennas 12, 12' shows that $\rho_e \leq 0.5$ or less across the entire band used by the LTE protocol. This result, combined with the good bandwidth and efficiency of the antennas 12, 12' means that they are suitable to meet the needs of LTE.

Figure 10:
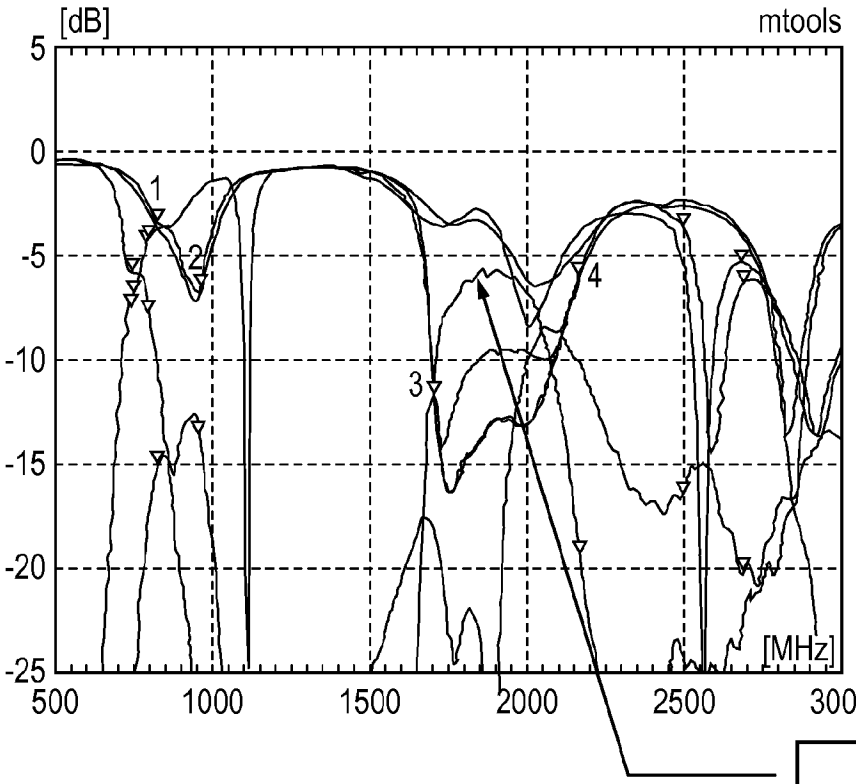
FIG. 10 shows a plot showing input matching and isolation for an embodiment of the present invention in isolation.

FIG. 10 shows a plot showing input matching and isolation, in two different states (i.e. with different inductors switched in between the antennas and ground) across four bands, namely the LTE 746-798 MHz band, the GSM band, the WCDMA band and the LTE 2500-2690 MHz band for an embodiment of the present invention in isolation.

Figure 11:
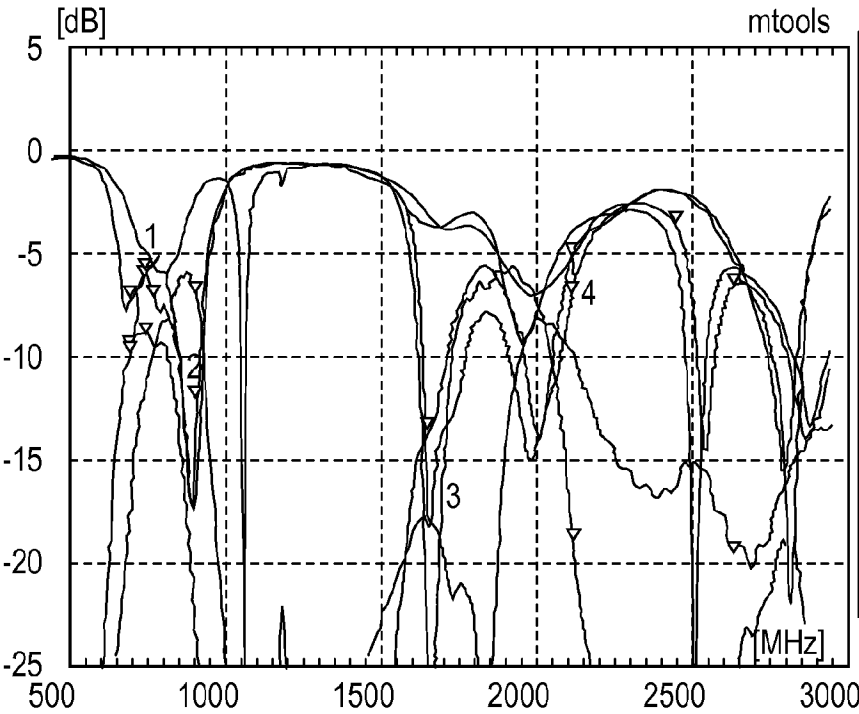
FIG. 11 shows a plot showing input matching and isolation for an embodiment of the present invention when plugged into a laptop computer.

FIG. 11 shows a plot corresponding to that of FIG. 10, but with the dongle 10 plugged into a laptop computer.

Figure 12:
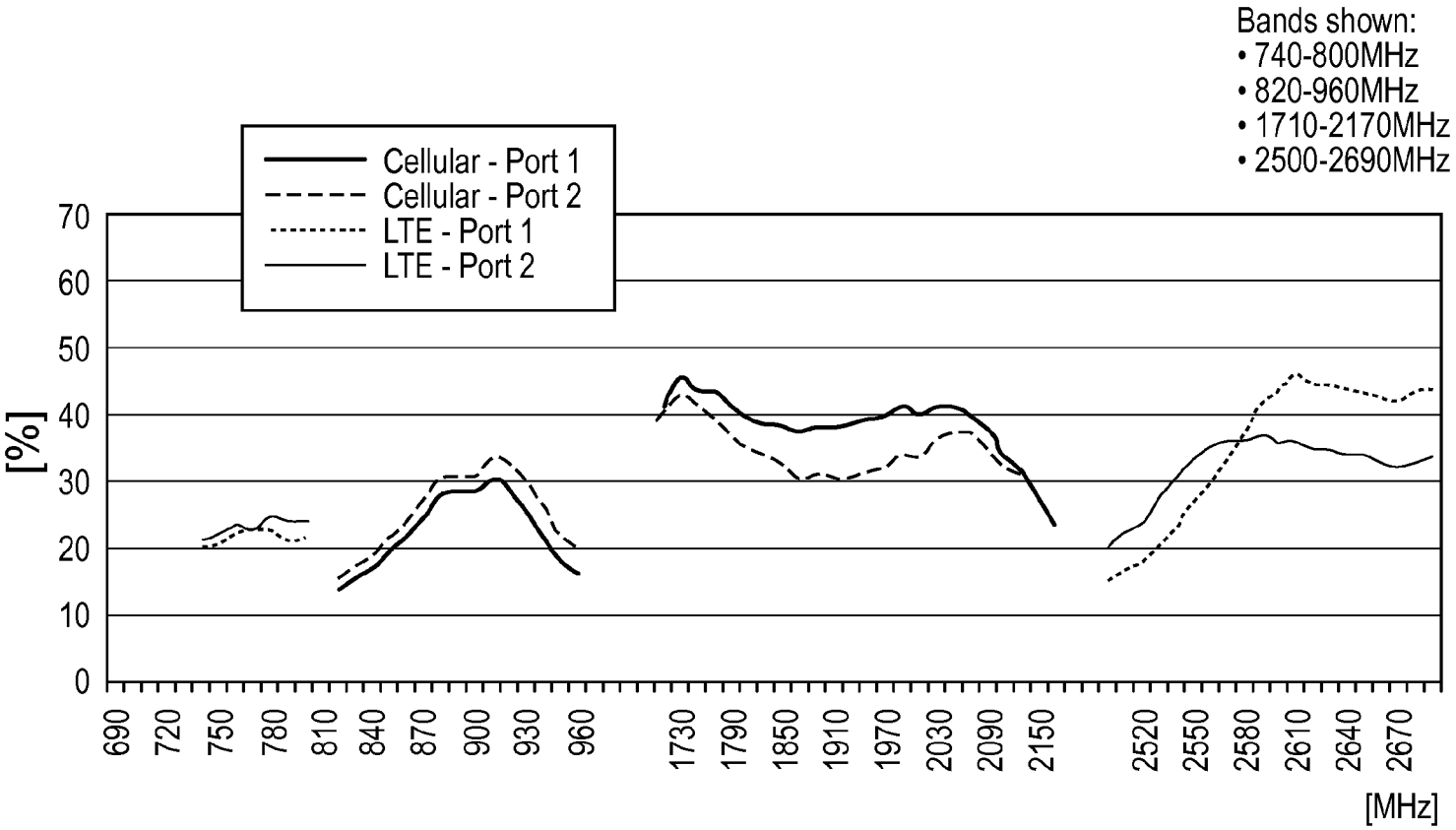
FIG. 12 shows a plot of antenna efficiency for an embodiment of the present invention in isolation.

FIG. 12 shows a plot of antenna efficiency for an embodiment of the present invention in isolation across four bands: 740-800 MHz, 820-960 MHz, 1710-2170 MHz and 2500-2690 MHz.

Figure 13:
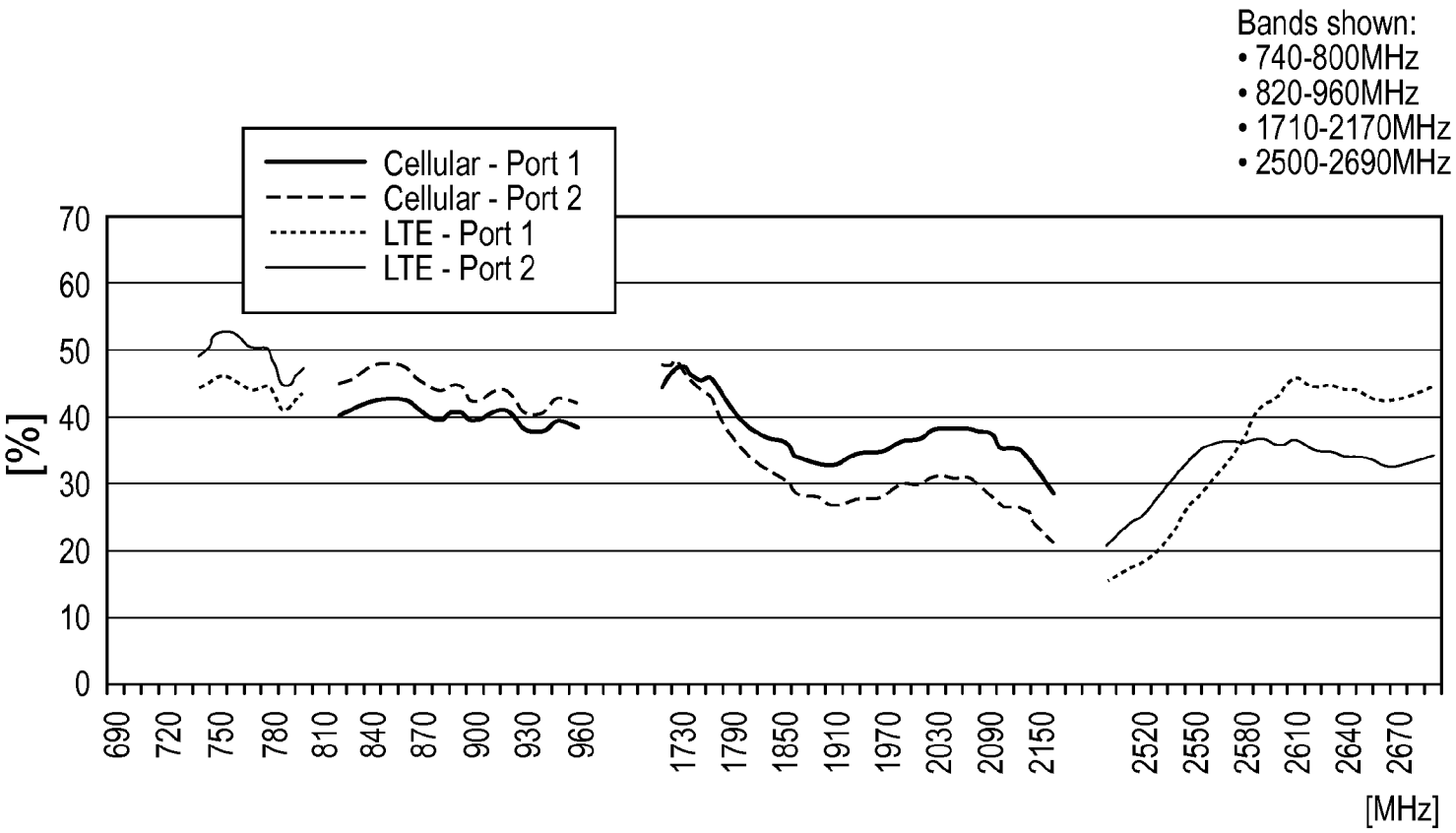
FIG. 13 shows a plot of antenna efficiency for an embodiment of the present invention when plugged into a laptop computer.

FIG. 13 shows a plot corresponding to that of FIG. 12, but with the dongle 10 plugged into a laptop computer.

Figure 14:
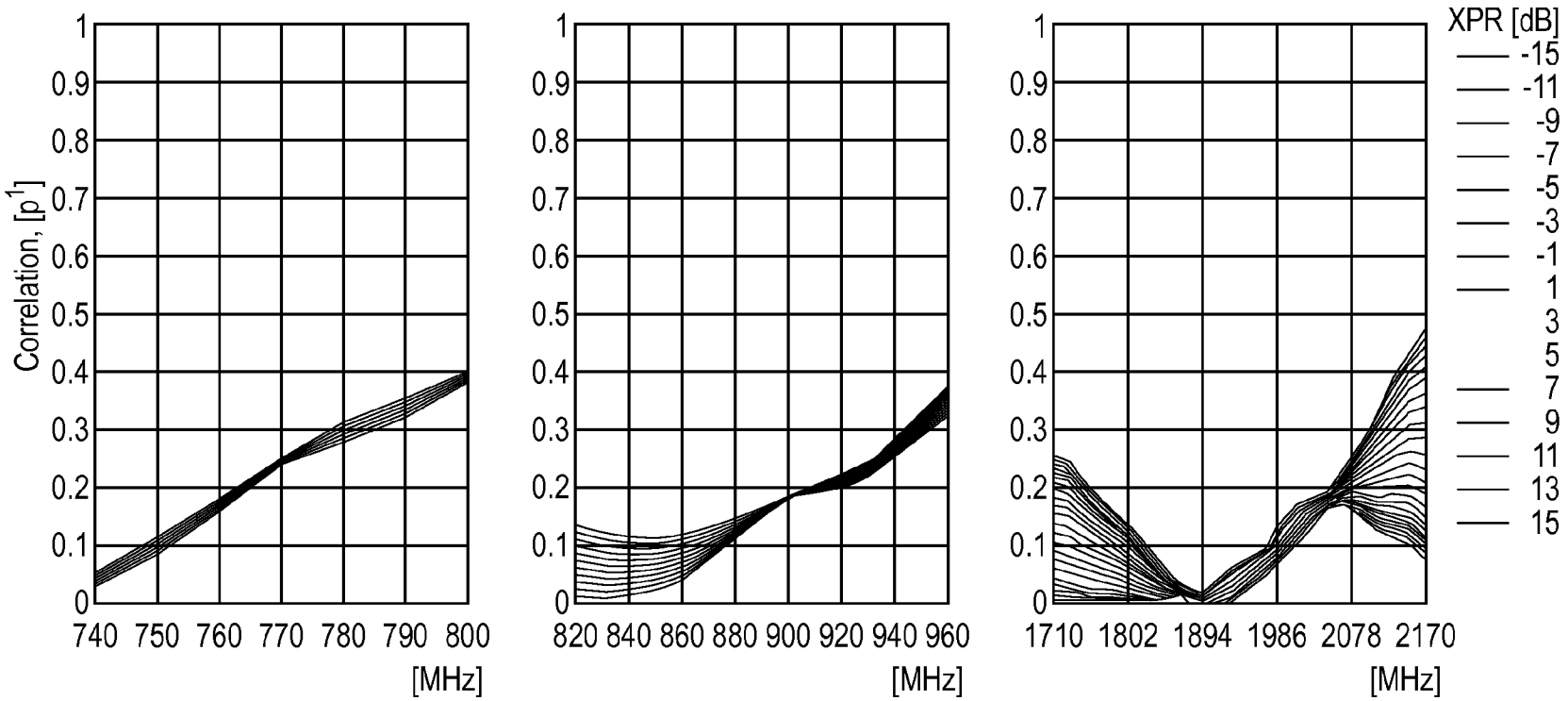
FIG. 14 shows an isotropic 3D propagation plot showing the correlation coefficient and cross-polarization power ratio values across different frequency bands of an embodiment of the present invention in isolation.

FIG. 14 shows an isotropic 3D propagation plot showing the correlation coefficient and cross-polarization power ratio values across different frequency bands (740-800 MHz, 820-960 MHz and 1710-2170 MHz) of an embodiment of the present invention in isolation; with the cross-polarization power ratio between −15 dB and +15 dB. It can be seen that the measured correlation coefficient $\rho_e \leq 0.5$ or less across all the bands, and indeed is less than 0.4 across most of the spectrum.

Figure 15:
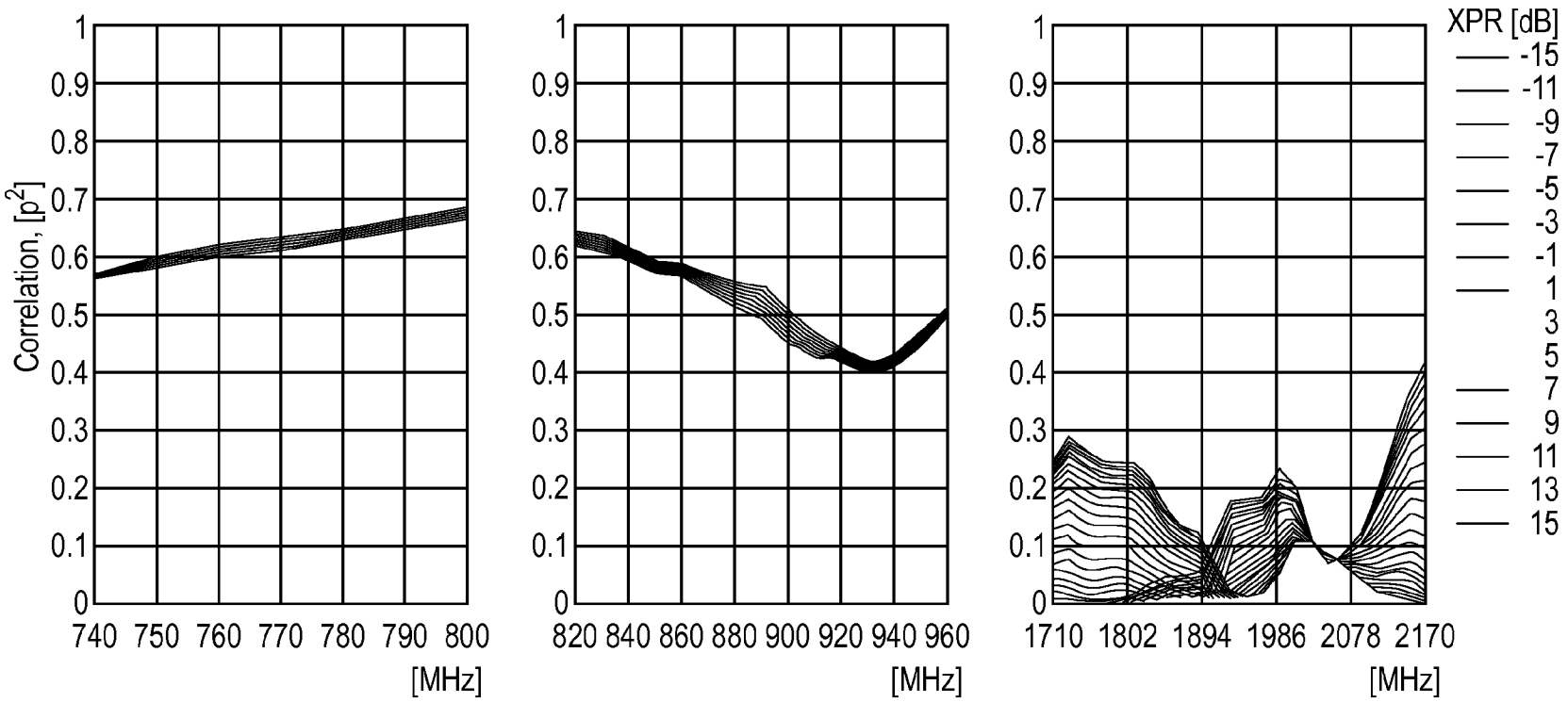
FIG. 15 shows an isotropic 3D propagation plot showing the correlation coefficient and cross-polarization power ratio values across different frequency bands of an embodiment of the present invention when plugged into a laptop computer.

FIG. 15 shows a plot corresponding to that of FIG. 12, but with the dongle 10 plugged into a laptop computer. Although the correlation coefficient is higher in the lower bands than when the dongle 10 is in isolation, it is still sufficiently low to allow good MIMO and diversity operation across the whole spectrum.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A multiple-input multiple-output (MIMO) antenna system comprising first and second folded or compacted loop antennas each having a longitudinal extent and mounted with the longitudinal extent of the first antenna in substantial parallel alignment with the longitudinal extent of the second antenna on a dielectric substrate having a conductive groundplane, wherein the groundplane extends between the first and second antennas, but wherein the first and second antennas are mounted on the substrate within ground clearance areas where there is no groundplane between each antenna and the substrate, and wherein the first and second antennas, in use, generate first and second radiation patterns and also cause currents to flow in the groundplane between the antennas so as to skew the first and second radiation patterns relative to each other by an angle greater than zero.

2. An antenna system as claimed in claim 1, wherein the first and second antennas are mounted opposite each other on the substrate.

3. An antenna system as claimed in claim 1, wherein loops of the first and second loop antennas are substantially co-axial.

4. An antenna system as claimed in claim 1, wherein each of the first and second loop antennas is configured as a loop of conductive track that is formed on a dielectric substrate in a compact manner by folding the loop over an edge of the substrate so to form first and second patches.

5. An antenna system as claimed in claim 1, wherein each of the first and second loop antennas is configured as a loop of conductive track that is formed on a dielectric substrate in a compact manner by forming first and second patches that are galvanically connected by way of vias in the substrate so as to define a compacted loop.

6. An antenna system as claimed in claim 1, wherein each of the first and second loop antennas is configured as a loop of conductive track that is formed on a dielectric substrate in a compact manner in a single plane by meandering or otherwise folding the conductive track.

7. An antenna system as claimed in claim 1, wherein the first and second antennas are be identical to each other in construction and/or performance.

8. An antenna system as claimed in claim 1, wherein the first and second antennas are different to each other in construction and/or performance.

9. An antenna system as claimed in claim 1, wherein a first end of each of the first and second loop antennas is connected to an RF feed.

10. An antenna system as claimed in claim 1, wherein a second end of each of the first and second loop antennas is connected to ground.

11. An antenna system as claimed in claim 1, wherein both a first end and a second end of each of the first and second loop antennas is connected to ground, and further comprising a separate driving antenna for each of the first and second loop antennas.

12. An antenna system as claimed in claim 10, wherein the second end of at least one of the first and second antennas is connected to ground by way of an inductive component.

13. An antenna system as claimed in claim 10, wherein the second end of at least one of the first and second antennas is connected to ground by way of a switch that allows at least two different inductive components to be selectively switched in between the second end and ground.

14. An antenna system as claimed in claim 1, wherein a correlation coefficient $P_e$ between the first and second antennas is no greater than 0.5 across predetermined frequency bands of operation.

15. An antenna system as claimed in claim 1, wherein, in use, the first and second radiation patterns are skewed relative to each other by an angle greater than 20 degrees.

16. An antenna system as claimed in claim 1, wherein, in use, the first and second radiation patterns are skewed relative to each other by an angle greater than 35 degrees.

17. An antenna system as claimed in claim 1, wherein, in use, the first and second radiation patterns are skewed relative to each other by an angle of substantially 50 degrees.

18. An antenna system as claimed in claim 1, wherein the ground clearance area for each of the first and second antennas extends to the edge of the substrate and the edge of the substrate is in substantially parallel alignment with the longitudinal extent of the first and second antennas.

19. A dongle for connection to a computer, the dongle comprising a multiple-input multiple-output (MIMO) antenna system comprising first and second folded or compacted loop antennas each having a longitudinal extent and mounted with the longitudinal extent of the first antenna in substantial parallel alignment with the longitudinal extent of the second antenna other on a dielectric substrate having a conductive groundplane, wherein the groundplane extends between the first and second antennas, but wherein the first and second antennas are mounted on the substrate within ground clearance areas where there is no groundplane between each antenna and the substrate, and wherein the first and second antennas, in use, generate first and second radiation patterns and also cause currents to flow in the groundplane between the antennas so as to skew the first and second radiation patterns relative to each other by an angle greater than zero.

20. A dongle for connection to a computer as claimed in claim 19, wherein the ground clearance area for each of the first and second antennas extends to the edge of the substrate and the edge of the substrate is in substantially parallel alignment with the longitudinal extent of the first and second antennas.

21. A mobile phone handset comprising a multiple-input multiple-output (MIMO) antenna system comprising first and second folded or compacted loop antennas each having a longitudinal extent and mounted with the longitudinal extent of the first antenna in substantial parallel alignment with the longitudinal extent of the second antenna other on a dielectric substrate having a conductive groundplane, wherein the groundplane extends between the first and second antennas, but wherein the first and second antennas are mounted on the substrate within ground clearance areas where there is no groundplane between each antenna and the substrate, and wherein the first and second antennas, in use, generate first and second radiation patterns and also cause currents to flow in the groundplane between the antennas so as to skew the first and second radiation patterns relative to each other by an angle greater than zero.

22. A mobile phone handset as claimed in claim 21, wherein the ground clearance area for each of the first and second antennas extends to the edge of the substrate and the edge of the substrate is in substantially parallel alignment with the longitudinal extent of the first and second antennas.

* * * * *